US006791018B2

(12) United States Patent
Bazata

(10) Patent No.: US 6,791,018 B2
(45) Date of Patent: Sep. 14, 2004

(54) GUITAR SLING

(76) Inventor: William C. Bazata, 2026 Pleasant St., South Bend, IN (US) 46615

( * ) Notice: Subject to any disclaimer, the term of this patent is extended or adjusted under 35 U.S.C. 154(b) by 0 days.

(21) Appl. No.: 10/209,247

(22) Filed: Jul. 31, 2002

(65) Prior Publication Data

US 2004/0020344 A1 Feb. 5, 2004

(51) Int. Cl.[7] ..... G10D 3/00
(52) U.S. Cl. ..... 84/327; 84/329
(58) Field of Search ..... 84/327, 329, 280, 84/281; D17/99

(56) References Cited

U.S. PATENT DOCUMENTS 5,936,173 A * 8/1999 Tonon ..... 84/327
6,359,203 B1 * 3/2002 Cronos ..... 84/327

* cited by examiner

*Primary Examiner*—Kimberly Lockett
(74) *Attorney, Agent, or Firm*—R. Tracy Crump

(57) ABSTRACT

A guitar sling is disclosed that allows the musician to move and hold the guitar in any desirable instrument position with respect to the musician's body and that will "self-balance" the guitar in any position or orientation while the guitar is played. The sling consists of four basic components: a guitar strap, a length of cord, cord locks, a fixed strap coupler and a traveling strap coupler. The length of cord is connected between the strap buttons of the guitar and drawn taut across the back of the guitar body by the cord locks. The fixed strap coupler is connected to the strap button at the base of the guitar neck. The traveling strap coupler is mounted to the cord to freely slide along the length of the cord. One end of the guitar strap is connected to the fixed strap coupler while the other end is connected to the traveling strap coupler.

30 Claims, 14 Drawing Sheets

GUITAR SLING

This invention relates to a guitar sling, and specifically a guitar sling that allows the musician to move and hold the guitar in any desirable instrument position, while also "self-balancing" the guitar in that position during performance.

BACKGROUND OF THE INVENTION

Guitar straps for supporting a guitar during performance are well known in the music industry. Conventional guitar straps consist of lengths of webbing, leather or cloth whose ends are connected to the strap buttons found on most guitars. The strap buttons of conventional guitars are located at opposite ends of the guitar body. When attached, the strap is worn over the musician's shoulder so that the guitar is suspended at the front of the musician in position and orientation in which the musician can play the instrument.

Conventional guitar straps provide the musician with a limited ability to adjust the guitar's placement and orientation (instrument position) with respect to the musician's body. The instrument can be raised or lowered with respect to the musician (vertical adjustment) by changing the length of the strap. Of course, changing the length of the guitar strap is impractical during performance. More importantly, guitar musicians often need to reposition the guitar with respect to the musician's body in order to have greater access to the neck or bridge as performance requires. Musicians may shift the guitar horizontally left or right across the musician's body, or rotate the guitar to gain better access to the neck. Conventional guitar straps limit the range of instrument positions and will not support and balance the guitar in these various positions. Gravity and the external force exerted on the guitar by the musician during performance will cause the guitar to shift and settle back to a natural balanced instrument position created by the connection of the guitar strap to the guitar. Consequently, the musician must physically support and balance the guitar in any particular position while performing. In trying to support the guitar in any particular instrument position, the musician may need to alter his own posture, which can affect the musician's performance in some manner or degree.

While allowing for some limited range of adjustment, conventional guitar straps do not afford musicians the freedom or ability to readily move and support the guitar in any desired instrument position. Consequently, a need exists for a guitar strap that allows a guitar to be supported in any desired instrument position. In addition, a need exists for a guitar strap that will support and balance that instrument position without altering the musician's performance.

SUMMARY OF INVENTION

The guitar sling of this invention allows the musician to move and hold the guitar in any desirable instrument position, that is any position and orientation of the guitar with respect to the musician's body. The sling will "self-balance" the guitar in any instrument position and maintain that position while the guitar is played. The term, "self-balancing" means that the guitar will balance and right itself in any position so that the weight of the guitar is naturally supported by the sling without the musician altering his own posture in order to hold or play of the guitar.

Four different embodiments of the guitar sling of this invention are described herein. Each embodiment of the sling consists of four basic components: a guitar strap, a length of cord, cord locks, a fixed strap coupler and a traveling strap coupler. The length of cord is connected between the strap buttons of the guitar and drawn taut across the back of the guitar body by the cord locks. The fixed strap coupler is connected to the strap button at the base of the guitar neck. The traveling strap coupler is mounted to the cord to freely slide along the length of the cord. One end of the guitar strap is connected to the fixed strap coupler while the other end is connected to the traveling strap coupler. The four embodiments of the sling of this invention function and operate identically and differ only in the manner in which the cord is secured to the strap buttons and the manner that the guitar strap is connected to the strap couplers.

The weight of the guitar is supported by the guitar strap, which is worn over the musician's shoulder. The movement of the traveling strap coupler along the length of the cord allows the musician to selectively position the guitar in any position or orientation for an optimal instrument position. The guitar can be shifted and moved horizontally left and right across the front of the musician, as well as rotated to change the angle of the guitar neck. As the position and orientation of the guitar changes with respect to the musician's body, the traveling strap coupler will shift along the length of the cord to compensate for gravitational and external force exerted on the guitar. The movement of the traveling strap coupler allows the "self balancing" of the guitar. Consequently, the musician can move the guitar from position to position without readjusting the sling or strap connections. The sling will "self-balance" the guitar in any position relative to the musician's body and maintain that position, while allowing the guitar to be freely played.

Accordingly, an advantage of this invention is that the sling allows the musician to move and hold the guitar in any desirable instrument position with respect to the musician's body.

Another advantage is that the sling will "self-balance" the guitar in any instrument position and maintain that position while the guitar is played.

Another advantage is this guitar sling provides greater musician comfort because the guitar can be shifted between optimal instrument positions during a performance.

Another advantage is that the sling is for the musician because the strap contacts more of the musicians back and shoulders.

Another advantage is that the sling provides a safe and secure connection to the guitar.

Another advantage is that the sling can be used with other conventional guitar straps.

Another advantage is that the sling components, except for the guitar strap are not visible during performance and therefore do not detract from the aesthetic appearance of the guitar.

Other advantages will become apparent upon a reading of the following description.

BRIEF DESCRIPTION OF THE DRAWINGS

The drawings of this invention have been depicted for illustrative purposes only wherein.

DESCRIPTION OF THE INVENTION

Figure 1:
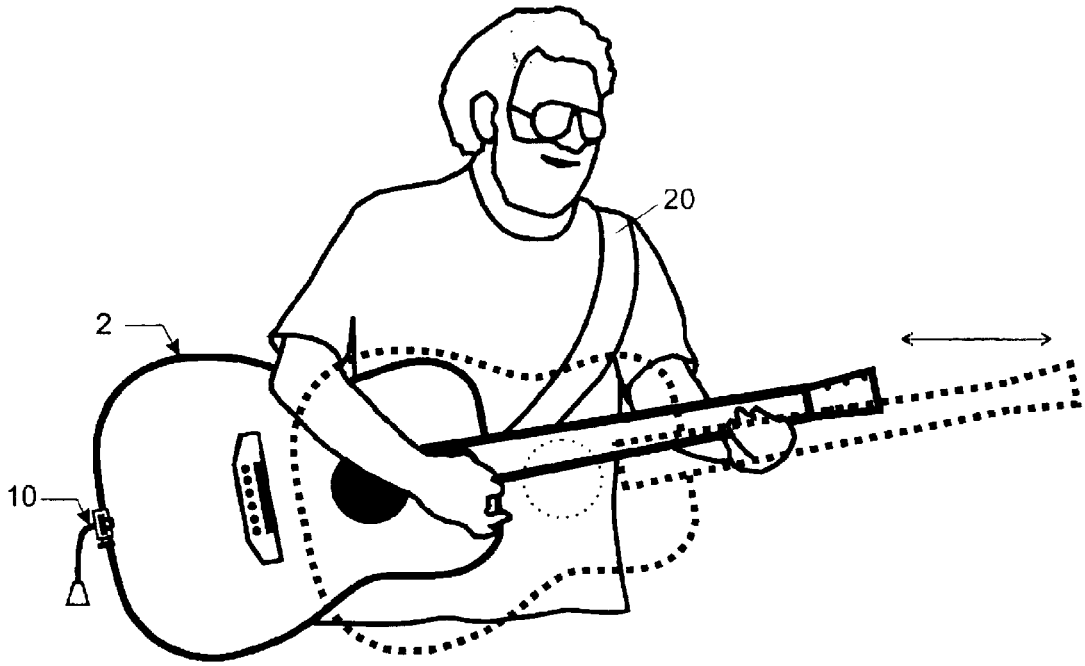
FIG. 1 is a perspective view of the front of a musician using a guitar and the guitar sling of this invention to show horizontal adjustment of the position of the guitar with respect to the musician.
Figure 2:
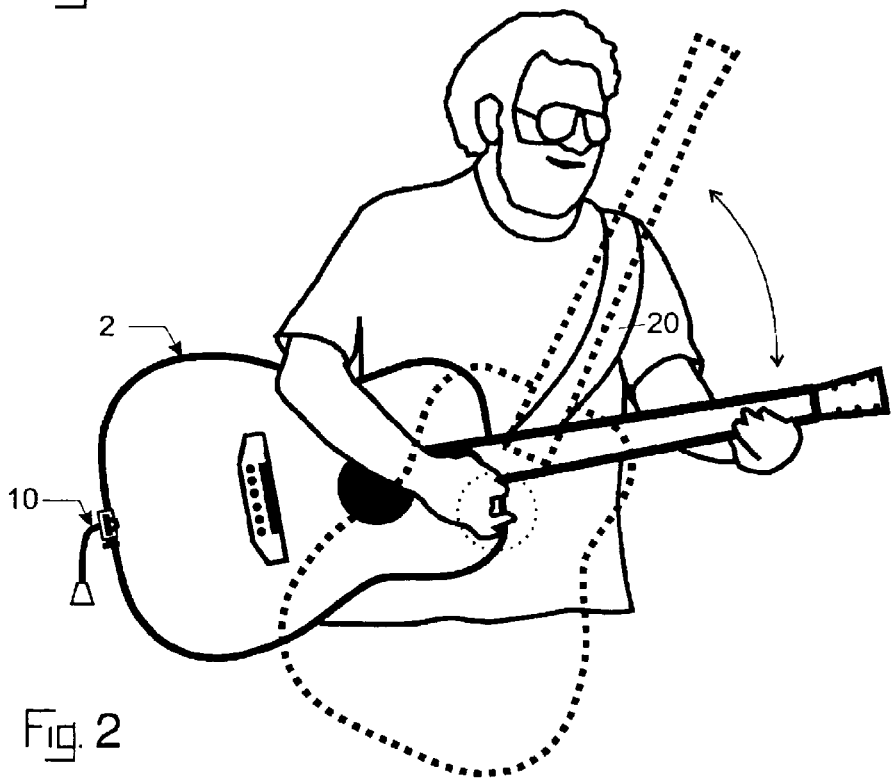
FIG. 2 is a perspective view of the front of a musician using a guitar and the guitar sling of this invention to show pivotal adjustment of the position of the guitar with respect to the musician.
Figure 3:
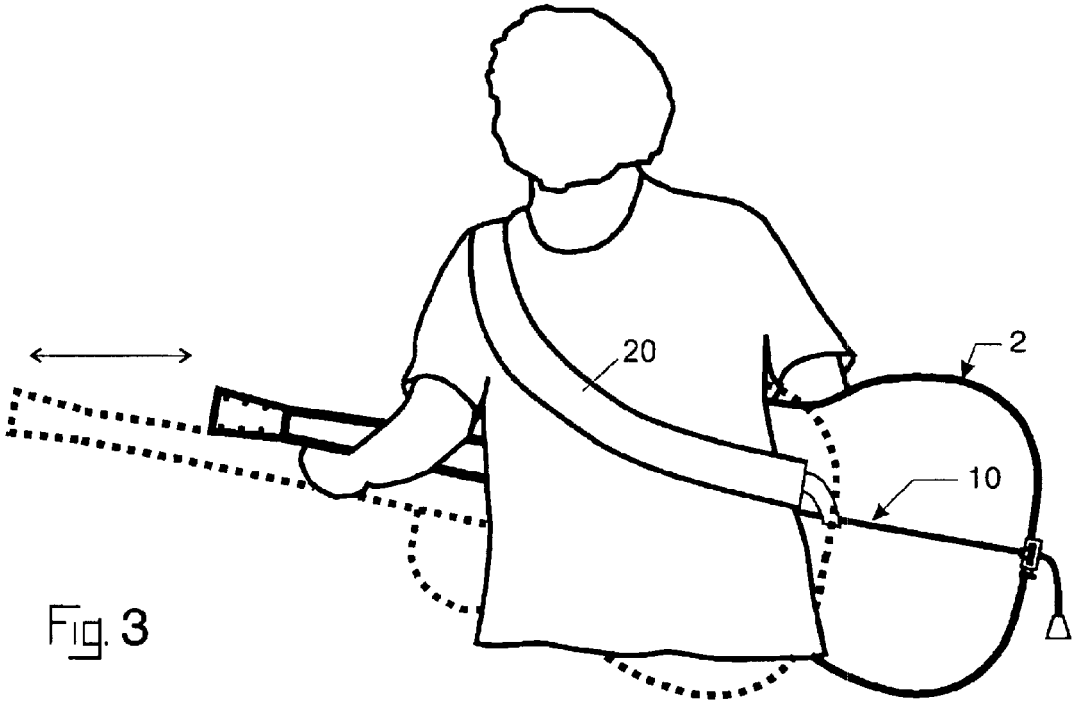
FIG. 3 is a perspective view of the back of a musician using a guitar and the guitar sling of this invention to show horizontal adjustment of the position of the guitar with respect to the musician.
Figure 4:
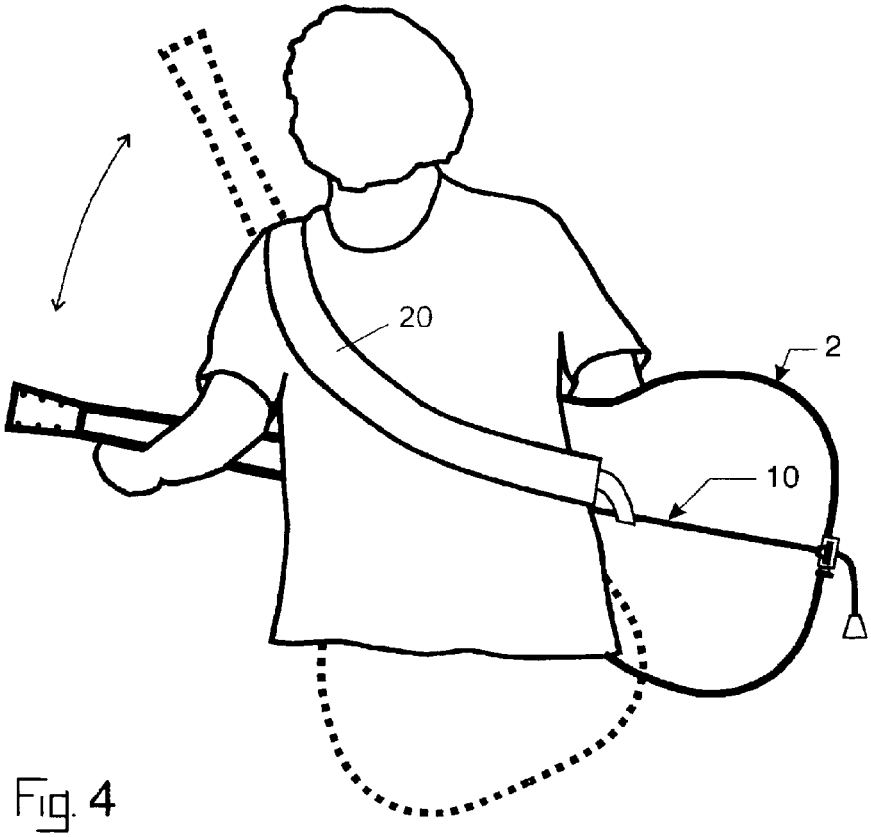
FIG. 4 is a perspective view of the back of a musician using a guitar and the guitar sling of this invention to show pivotal adjustment of the position of the guitar with respect to the musician.

The embodiments of the invention herein described are not intended to be exhaustive or to limit the invention to any of the precise forms disclosed. They are illustrated and described to explain the nature and scope of the invention so that others skilled in the art might utilize its teachings.

General Description of Slings and Guitar

The guitar slings of this invention are shown used with a conventional acoustic guitar (designated in the figures as reference numeral 2), for illustrative purposes only, and may be used with any type of guitar or other stringed instrument. As illustrated in the figures, guitar 2 includes a body 4 and an elongated neck. Guitar 2 also includes two strap buttons 6 and 8, which provide connection points for conventional guitar straps (not shown). Strap buttons 6 consist of a button shaped stud with a head larger than its shaft. One strap button 6 extends from one end of guitar body 4 at the base of neck 6 and other strap button 6 extends from the opposite end of guitar body 4.

Four different embodiments of the guitar sling of this invention are described herein. Each embodiment of the sling consists of four basic components: a guitar strap, a length of cord, cord locks, a coupler and a traveler. The four embodiments of the sling of this invention function and operate identically and differ only in the manner in which the cord is secured to the strap buttons and the manner that the guitar strap is connected to the strap couplers.

First Embodiment: Direct Cord Attachment/Quick Release Connection

FIGS. 5–9 illustrate the first embodiment of the guitar sling of this invention designated generally as reference numeral 10. As shown, sling 10 includes a length of cord 12; two cord locks 14 and 15, a coupler 16, a traveler 18 and a guitar strap 20 (shown in FIGS. 5–9). In this embodiment of the guitar sling, the strap is connected to the coupler by a quick release buckle and the cord is connected directly to strap buttons 6 of guitar 2.

Guitar strap 20 is of conventional design, well known to guitar musicians. Guitar strap 20 is used to drape over the musician's shoulder to support the guitar. Although not shown, guitar strap 20 includes a length adjustment 22, such as a belt and buckle assembly for varying the length of the strap. The quick release buckles of sling 10 includes a male receiver 24 and an interconnecting female latch 26. As shown, the male receiver 24 is connected to the free end of both coupler 16 and traveler 18. Two female latches 26 are connected to opposite ends of guitar strap 20.

Cord 12 acts as a guide line for traveler 18. Cord 12 is typically a braided nylon, but any suitable cord material may be employed. Alternatively, a length of thin strap or webbing of cloth, nylon, or braided leather can be substituted for a cord, provided that the strap or webbing allows for free translational movement of traveler 18 along its length. Cord 12 has two end retainers 13. Cord locks 14 are used to quick cinch and secure cord 12 about strap button 6. Cord locks 14 are of conventional design and include a cylindrical body and a spring tensioned piston, which secure the cord that passes through an eyelet in the body. This type of cord lock is well known and of the type commonly employed to cinch and secure cord, wire and rope in a variety of applications. Coupler 16 and traveler 18 are used to connect guitar strap 20 to cord 12 and guitar body 4. Coupler 16 and traveler 18 are constructed from a flexible material, typically a nylon webbing, a folded cloth or leather straps. Coupler 16 has an eyelet or grommet 17 at one end through which cord 12 passes. Traveler 18 is folded over itself to form a loop 19 through which cord 12 passes.

Figure 5:
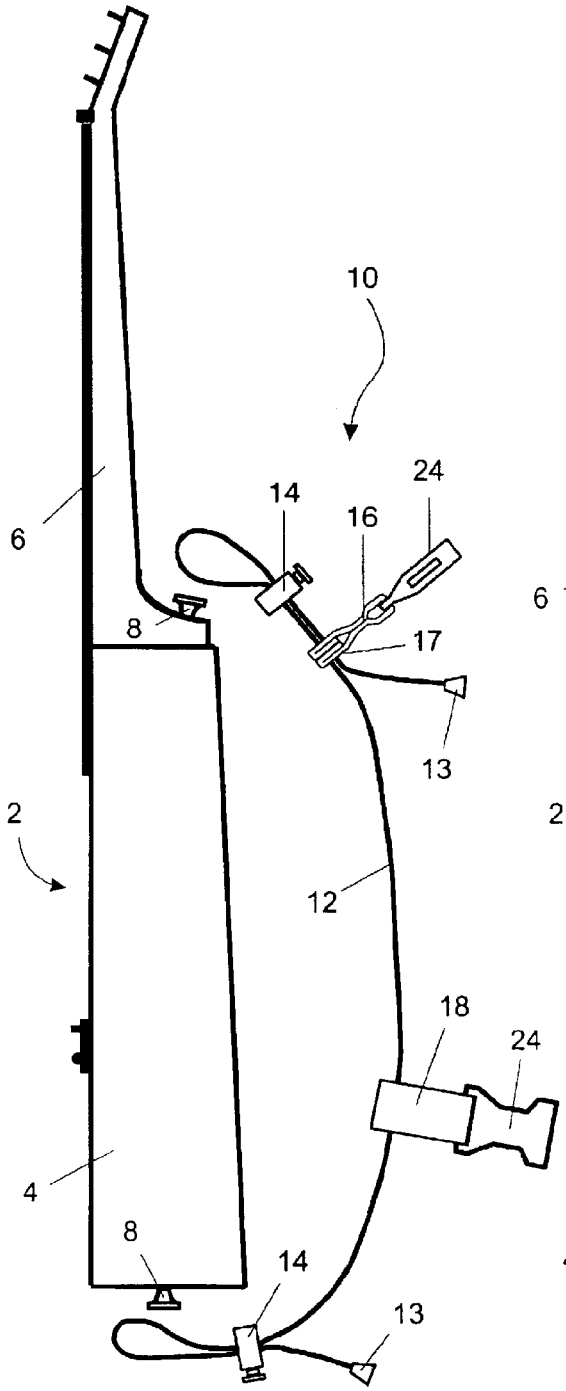
FIG. 5 is a side plan view of a guitar and a first embodiment of the sling of this invention showing the sling in an unattached position.
Figure 6:
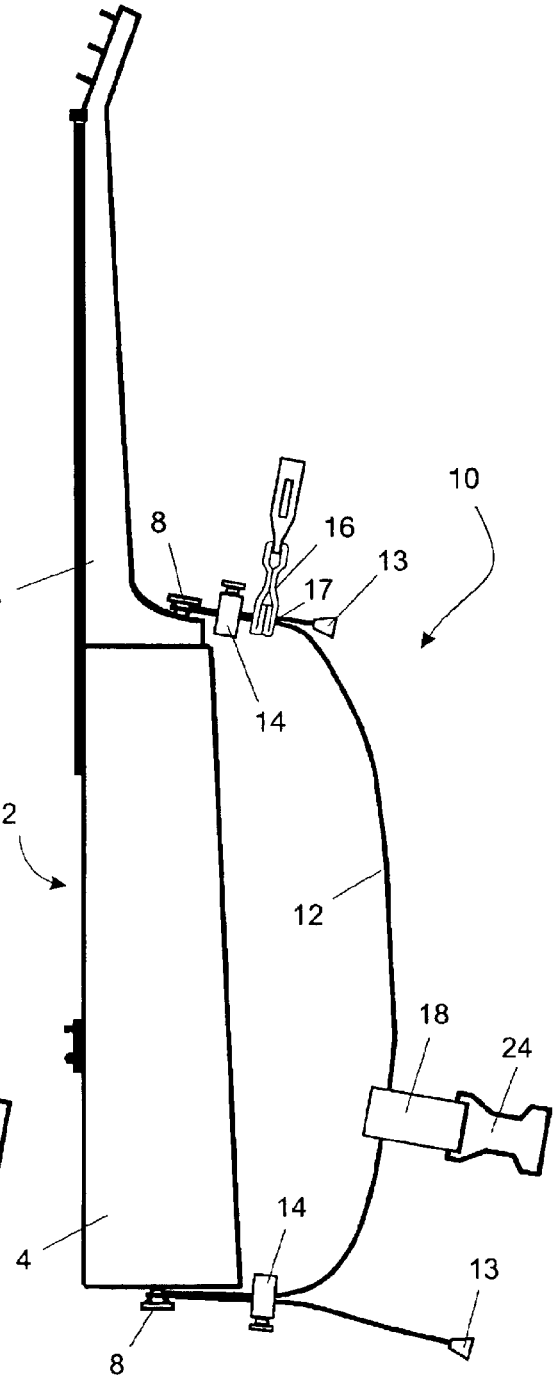
FIG. 6 is a side plan view of a guitar and the sling of FIG. 3 showing the cord loosely fitted to the strap buttons of the guitar.
Figure 7:
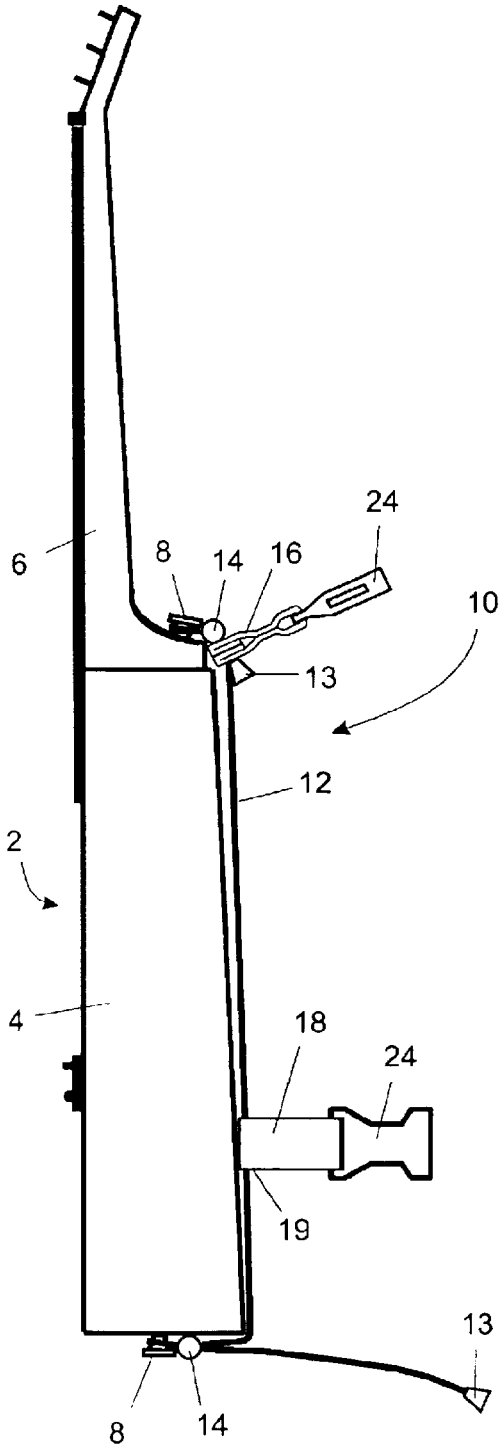
FIG. 7 is a side plan view of a guitar and the sling of FIG. 3 showing the cord drawn tight against the guitar body.
Figure 8:
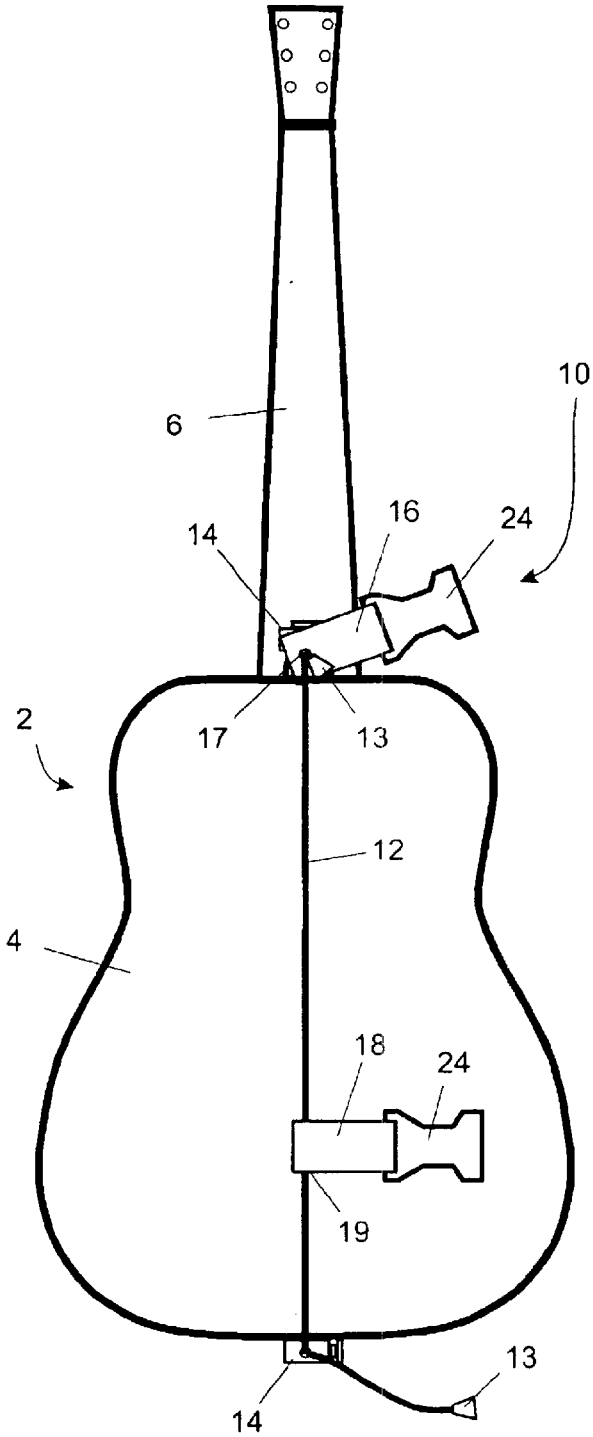
FIG. 8 is a back plan view of a guitar and the sling of FIG. 3 showing the cord drawn tight against the guitar body.
Figure 9:
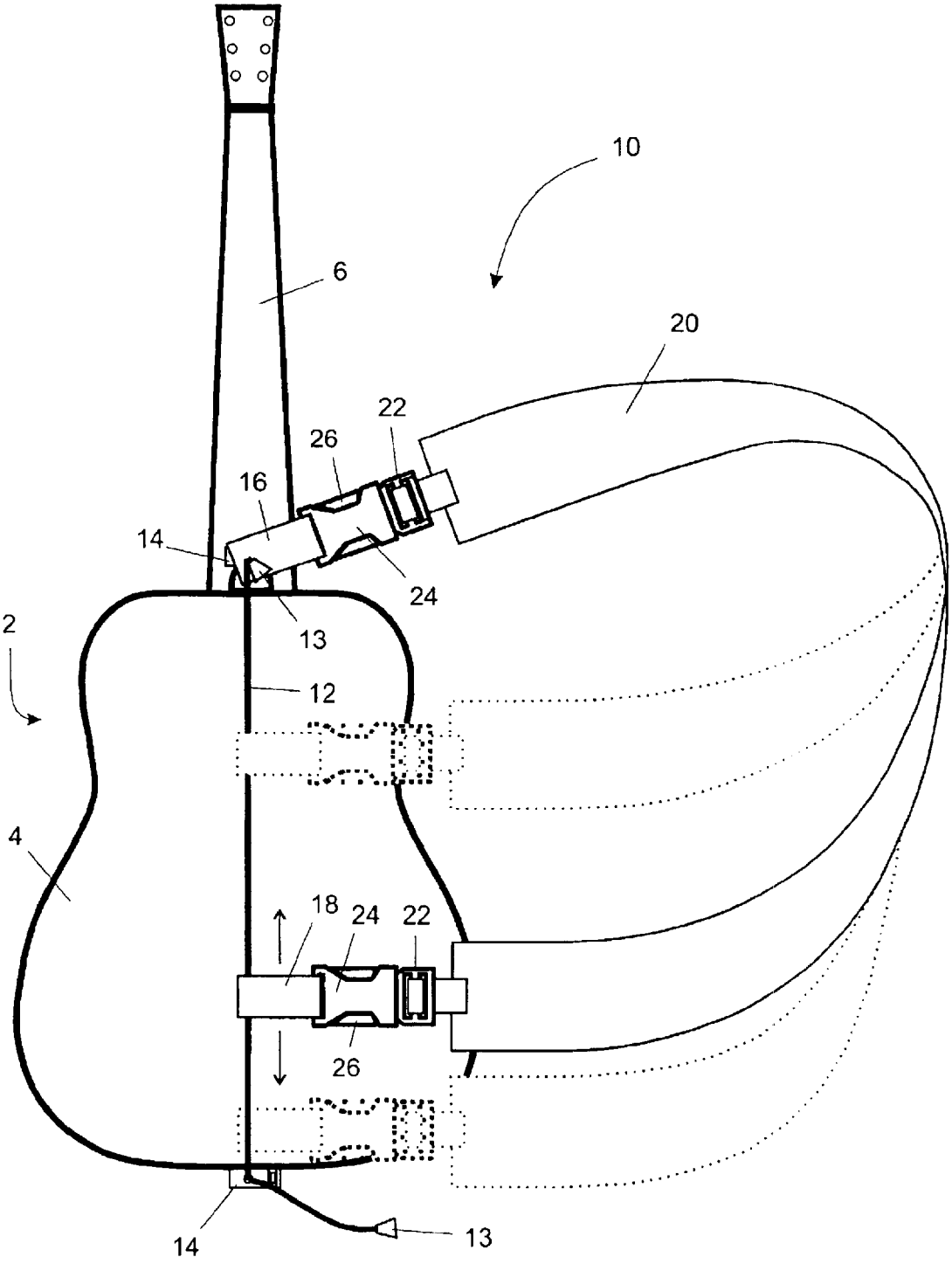
FIG. 9 is a back plan view of a guitar and the sling of FIG. 3 showing the movement of the traveler along the length of the cord.

As shown in FIGS. 5 and 6, one end of cord 12 extends through the first cord lock 14 and coupler 16 to form a loop, which wraps around strap button 8 at the base of neck 6. As shown in FIGS. 7 and 8, slack in cord 12 is drawn up so that cord retainer 13 abuts against coupler 16 to secure the couple between cord lock 14 and cord retainer 13 adjacent strap button 8. Once connected to strap button 8 at the base of neck 6, cord 12 is drawn taut across the back of guitar body 4. Cord 12 is pulled tight around strap button 6 at butt of guitar body 4 and secured by the second cord lock 14. While coupler 16 is secured at the base of neck 6, traveler 18 is free to slide up and down along cord 12 across the back of guitar body 4. As shown in FIG. 9, guitar strap 20 is connected to couplers 16 and traveler 18 using the quick release buckles.

Second Embodiment: Direct Cord Attachment/Strap Button Connection

Figure 10:
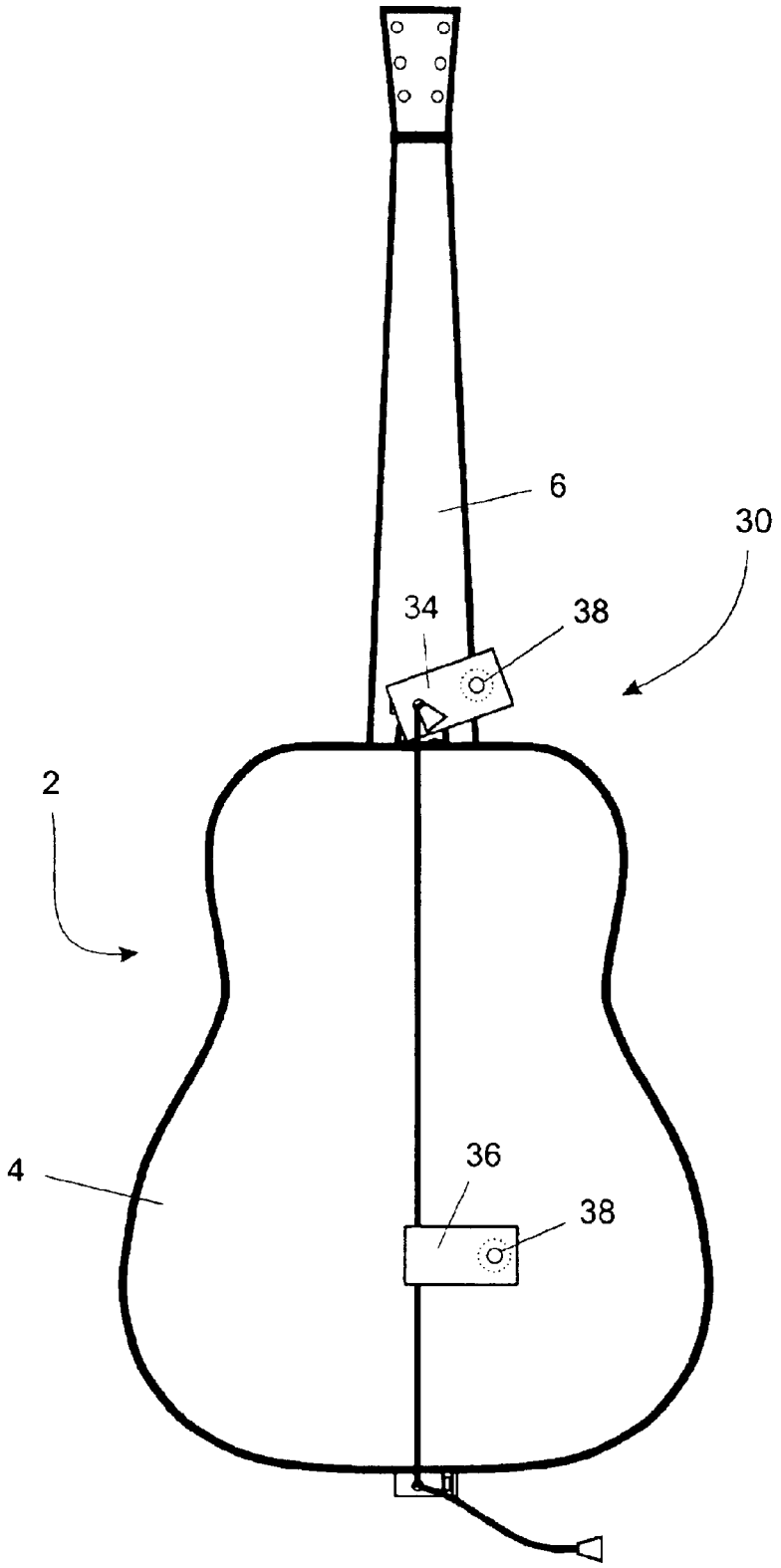
FIG. 10 is a back plan view of a guitar and a second embodiment of the sling of this invention showing the cord drawn tight against the guitar body.
Figure 11:
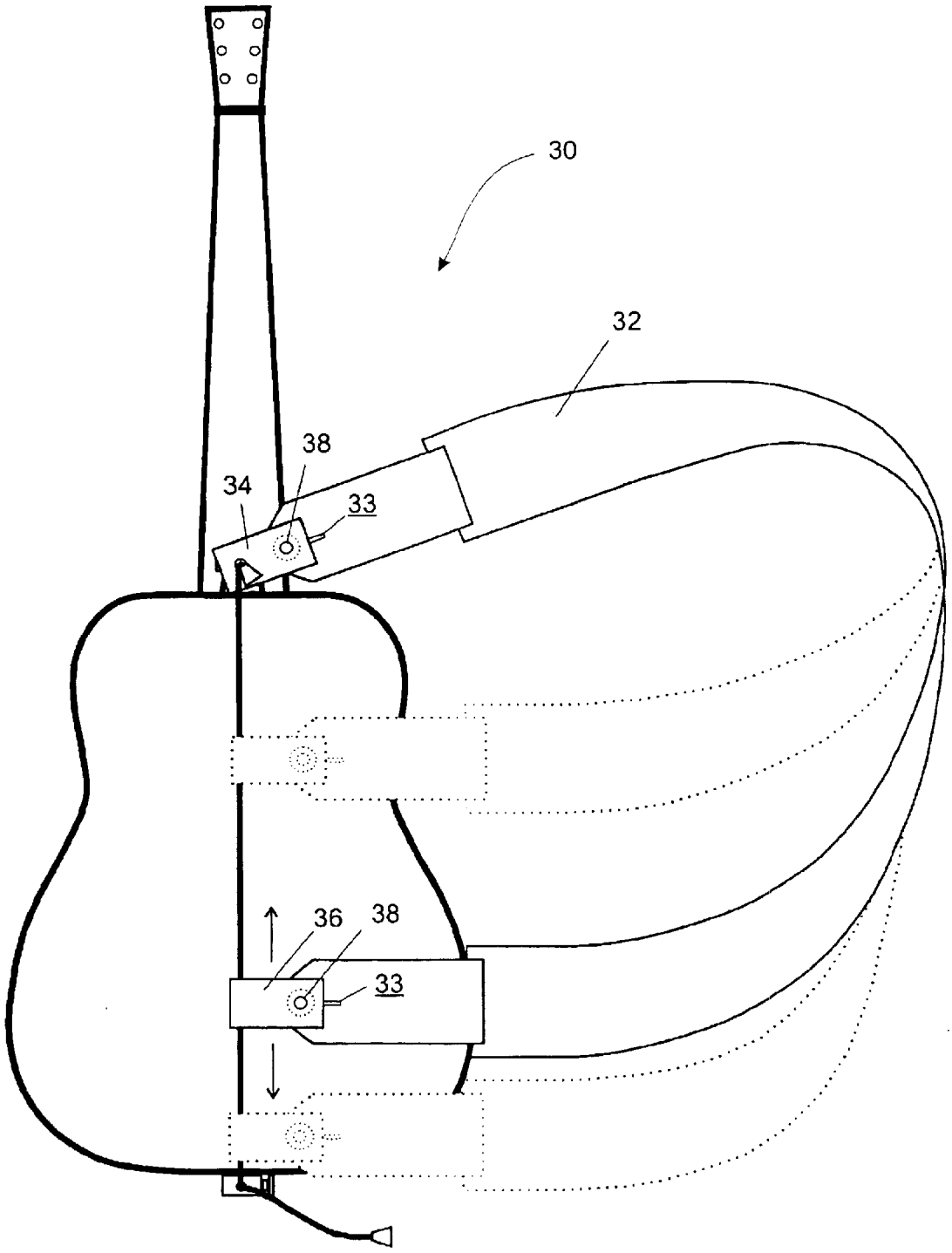
FIG. 11 is a back plan view of a guitar and the sling of FIG. 8 showing the movement of the traveler along the length of the cord.
Figure 12:
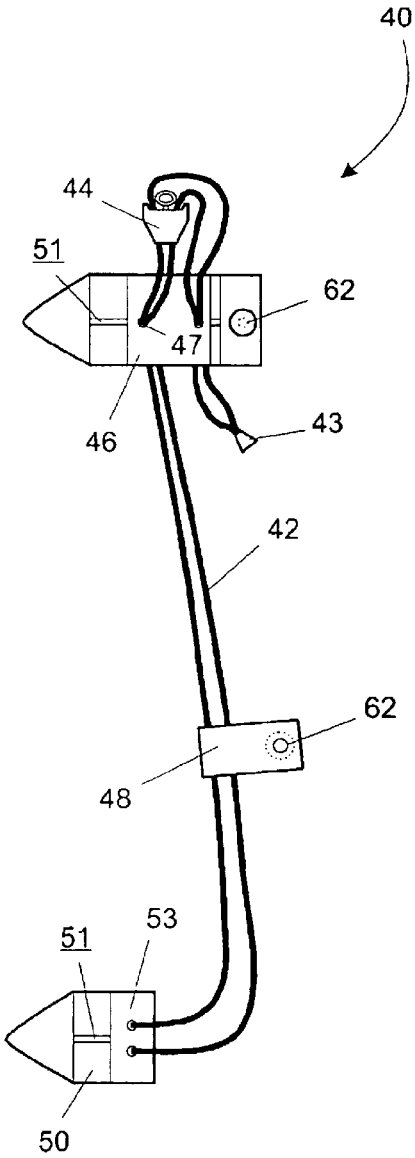
FIG. 12 is a perspective view of a third embodiment of the guitar sling of this invention.
Figure 13:
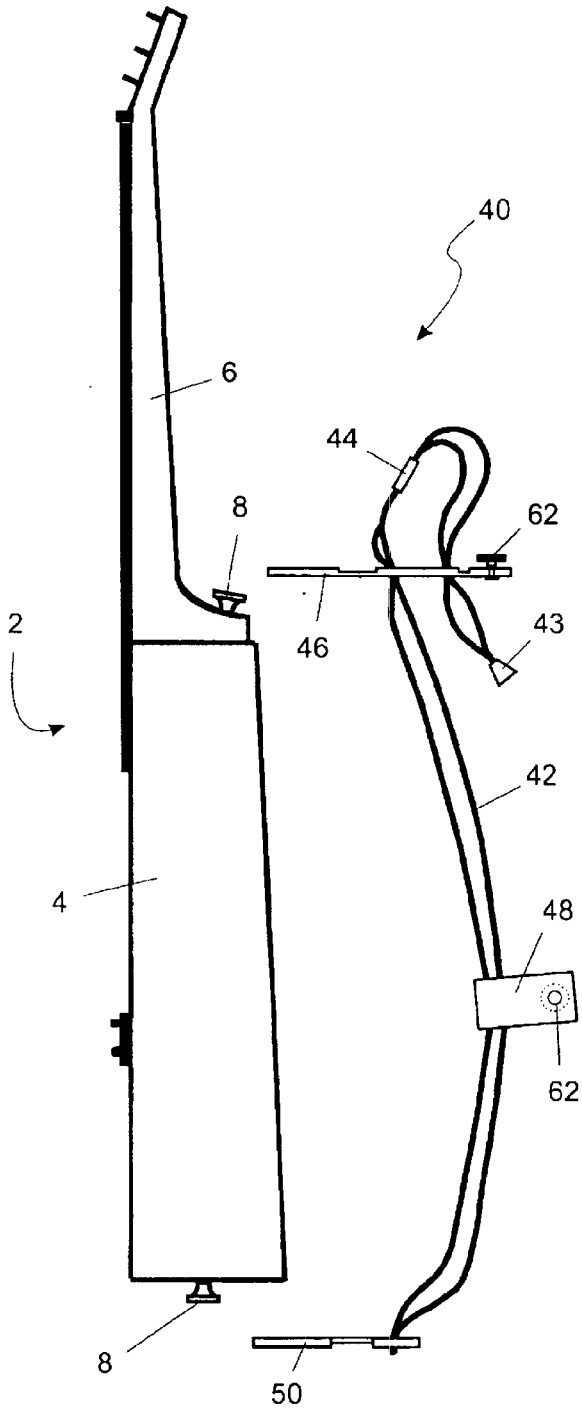
FIG. 13 is a side plan view of a guitar and the sling of FIG. 10 showing the sling in an unattached position.
Figure 14:
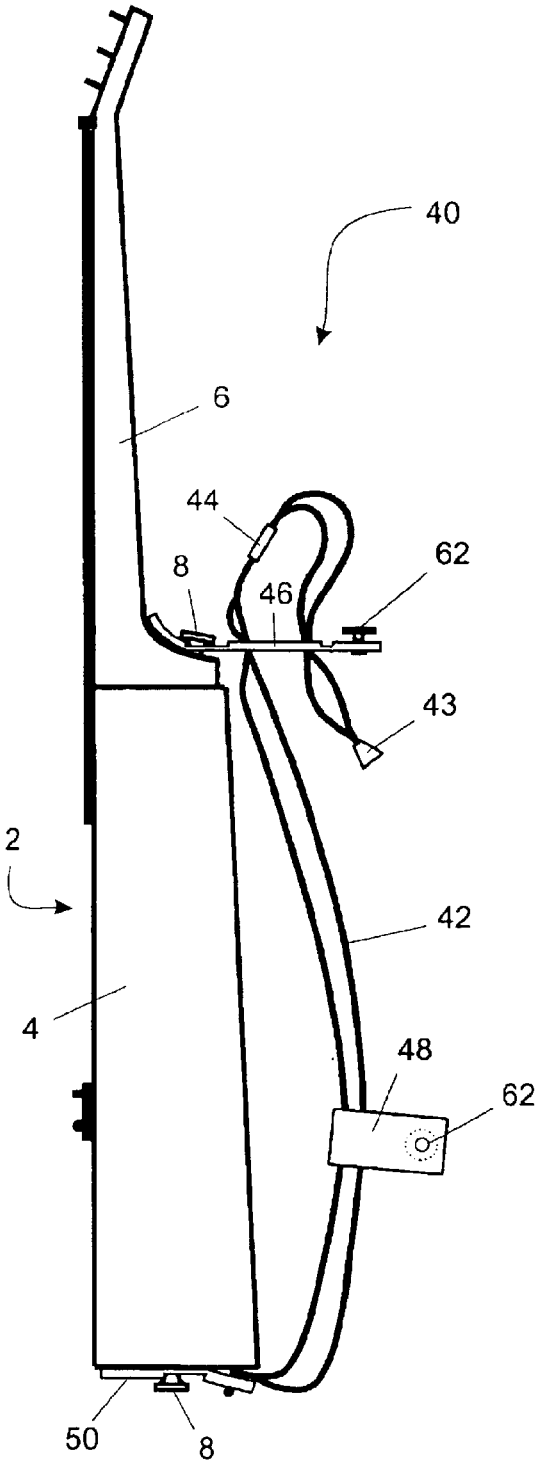
FIG. 14 is a side plan view of a guitar and the sling of FIG. 10 showing the cord loosely fitted to the strap buttons of the guitar.

FIGS. 10 and 11 illustrate a second embodiment of the guitar sling of this invention designated as reference numeral 30. This embodiment of the guitar sling is identical to the first embodiment of FIGS. 5–9 in construction and function, except that guitar strap 32 is connected to the coupler 34 and traveler 36 by a conventional button and buttonhole attachment. As shown, each end of guitar strap 32 has a slotted button hole 33 and coupler 34 and traveler 36 each include a connecting strap button 38.

Third Embodiment: Indirect Cord Attachment/Strap Button Connection

FIGS. 12–17 illustrate the third embodiment of the guitar sling of this invention designated generally as reference numeral 40. In this embodiment, the cord is fixed between a pair of couplers that are connected directly to the strap buttons and tightened by a single cord lock. The traveler again slides along the length of the doubled cord across the back of the guitar body. In this embodiment, the guitar strap is again connected to the couplers by a button and buttonhole attachment.

As shown, sling 40 includes a length of cord 42; a cord lock 44, two couplers 46 and 50, a traveler 48, and a guitar strap 60 (shown in FIGS. 12–17). Again, couplers 46, 50 and traveler 48 are constructed from a flexible material, typically a nylon webbing, a folded cloth or leather straps. In this embodiment, coupler 46 is connected directly to strap button 6 at the base of neck 6. Coupler 50 is connected to strap button 8 at the base of guitar body 4. Both couplers 46 and 50 have slotted buttonholes 51 for connectively receiving strap buttons 6 of guitar 2. As shown, cord 42 is looped through two eyelets 53 in coupler 50 with the two ends passing two eyelets 47 of coupler 46 and joined by a retainer 43. Traveler 48 is fold over itself to form a loop 49 through which cord 12 doubled over itself passes. Cord lock 44 is of conventional design and includes a trapezoidal shaped body and a spring tensioned wedge shaped piston, which secures both ends of cord 42 that pass through the lock body. This type of cord lock is well known and of the type commonly employed to cinch and secure both ends of a cord, wire and rope in a variety of applications.

Figure 15:
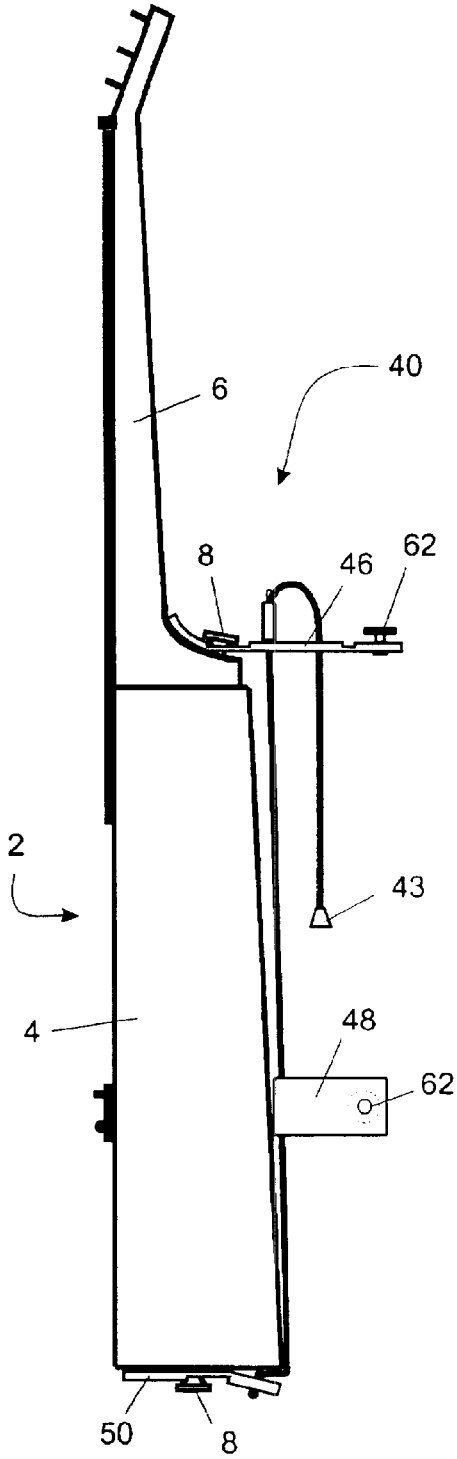
FIG. 15 is a side plan view of a guitar and the sling of FIG. 10 showing the cord drawn tight against the guitar body.
Figure 16:
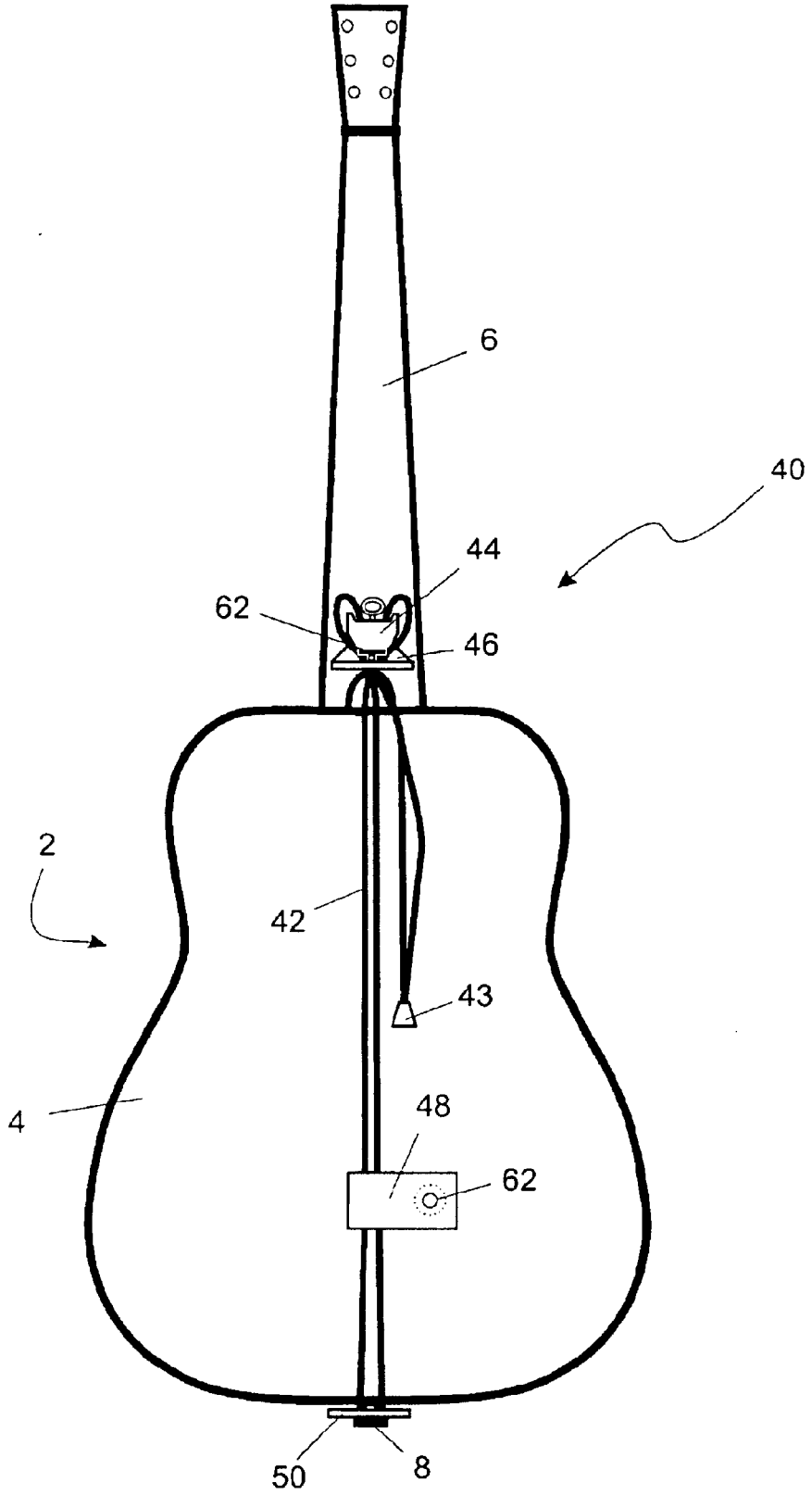
FIG. 16 is a back plan view of a guitar and the sling of FIG. 10 showing the cord drawn tight against the guitar body.
Figure 17:
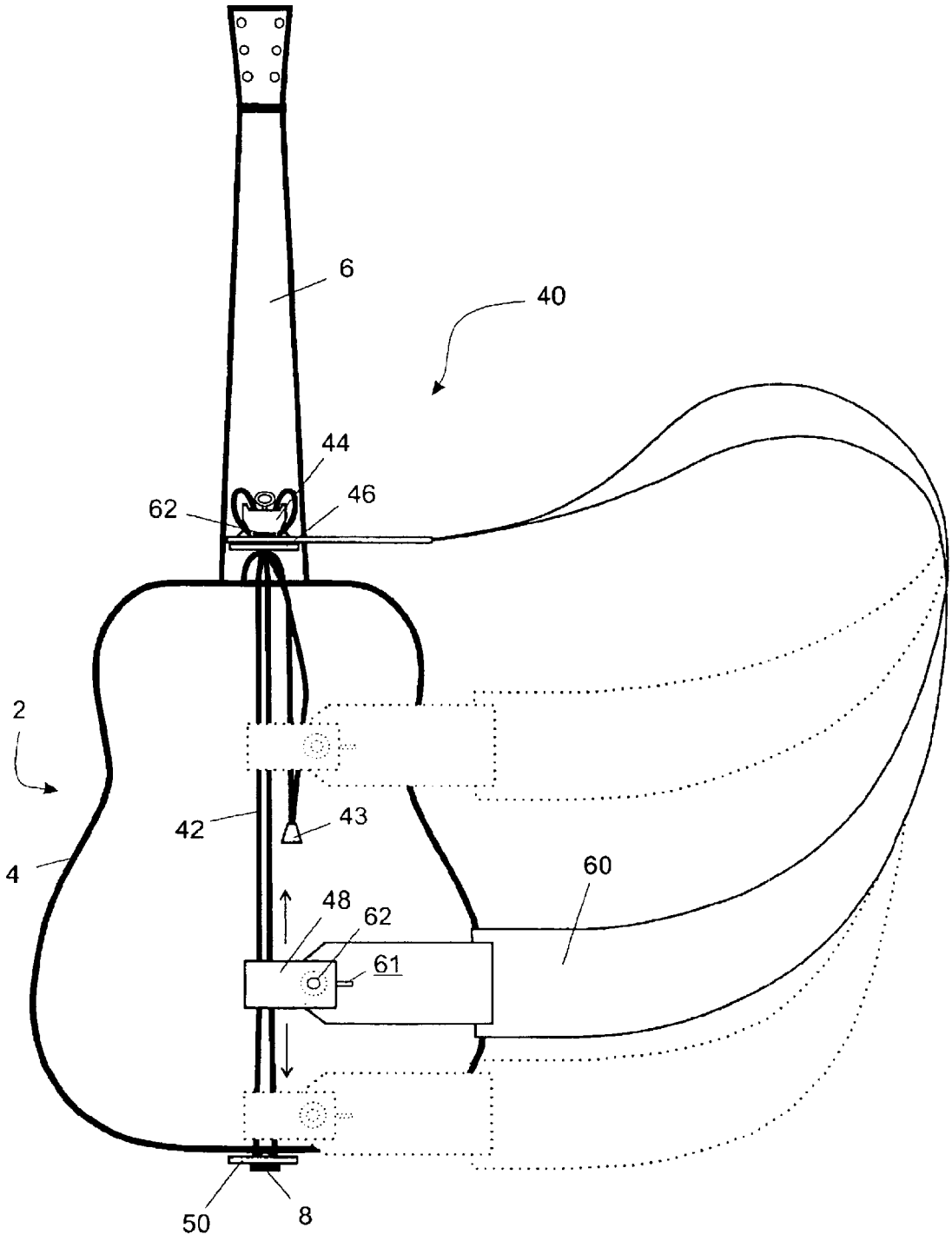
FIG. 17 is a back plan view of a guitar and the sling of FIG. 10 showing the movement of the traveler along the length of the cord.
Figure 18:
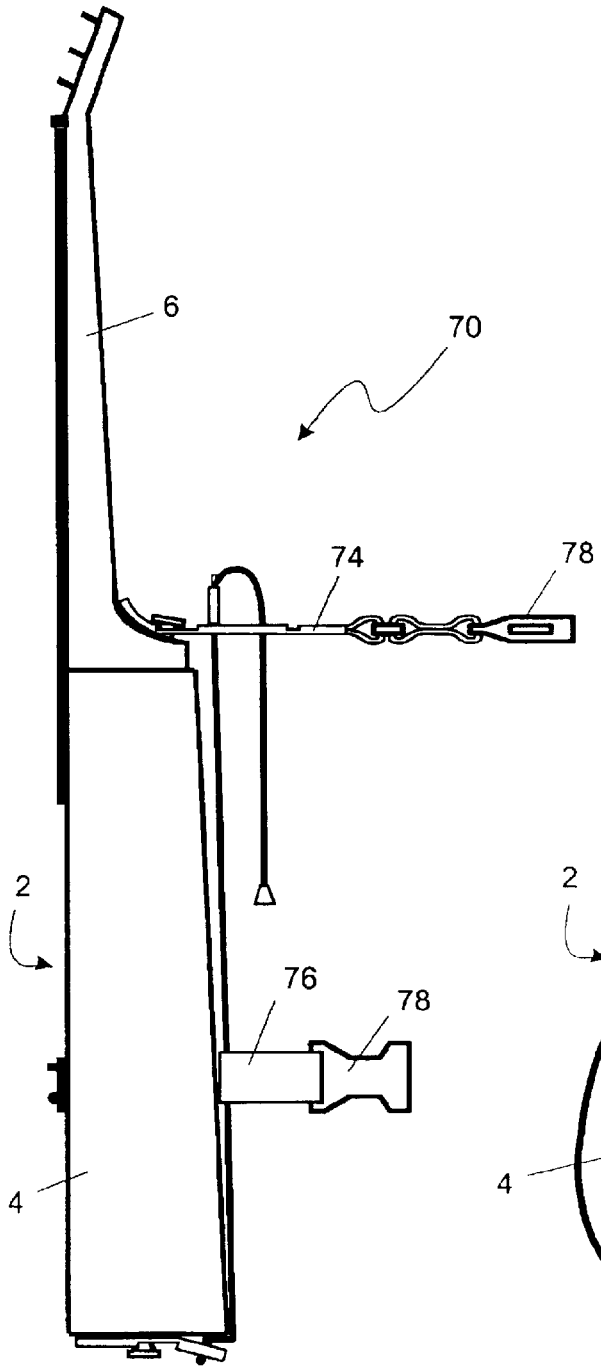
FIG. 18 is a side plan view of a guitar and a fourth embodiment of the sling of this invention showing the cord drawn tight against the guitar body.
Figure 19:
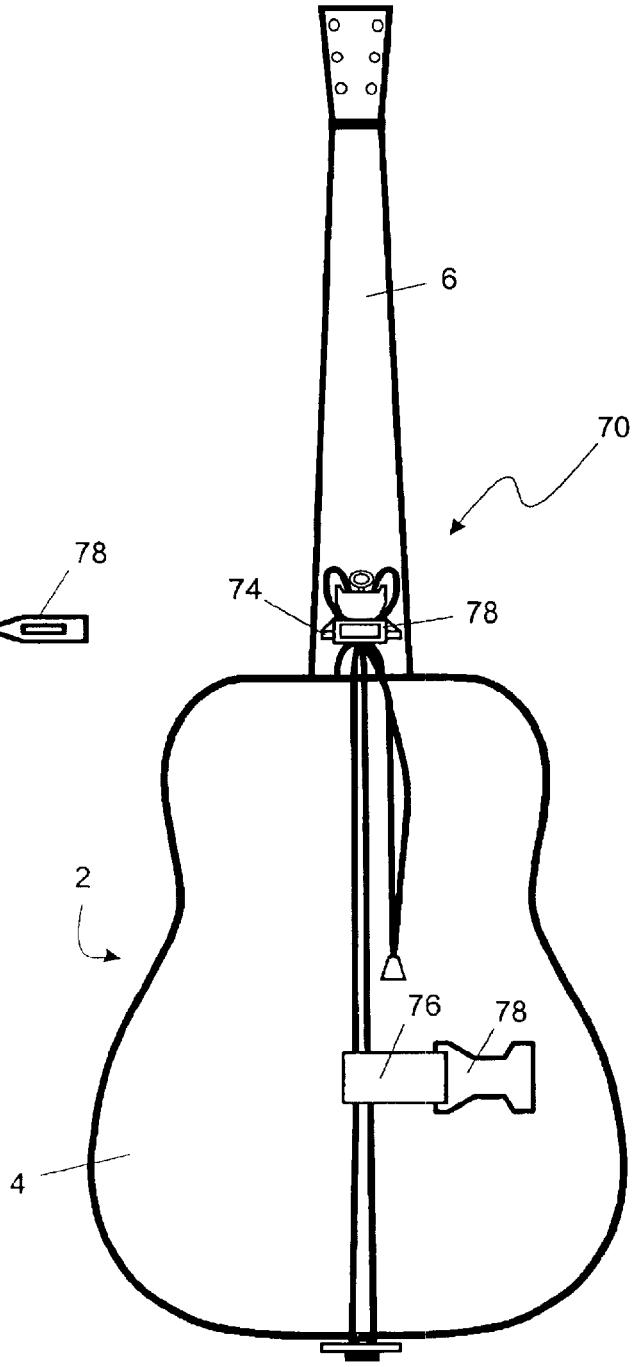
FIG. 19 is a back plan view of a guitar and the sling of FIG. 16 showing the cord drawn tight against the guitar body.
Figure 20:
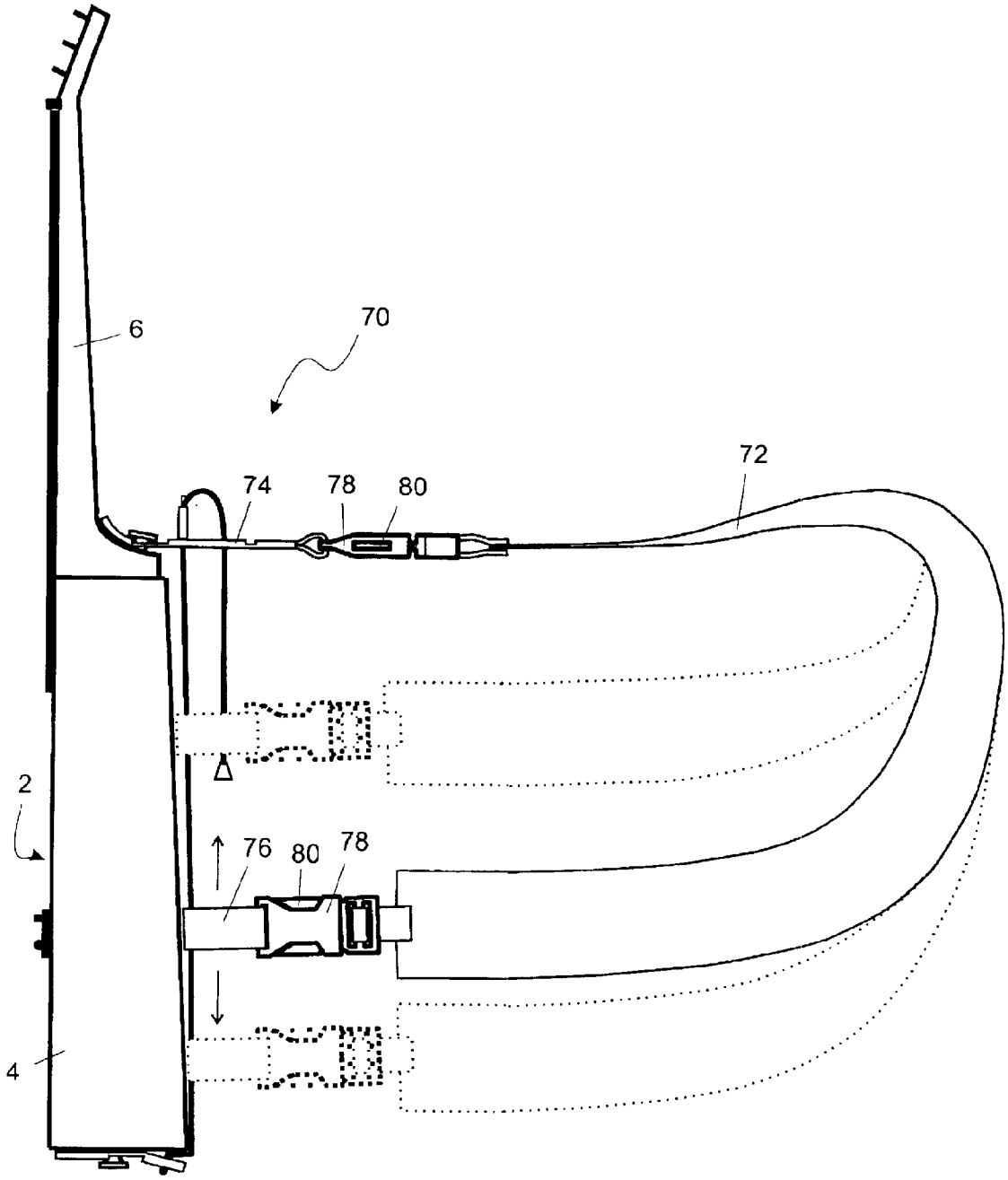
FIG. 20 is a side plan view of a guitar and the sling of FIG. 16 showing the movement of the traveler along the length of the cord.
Figure 21:
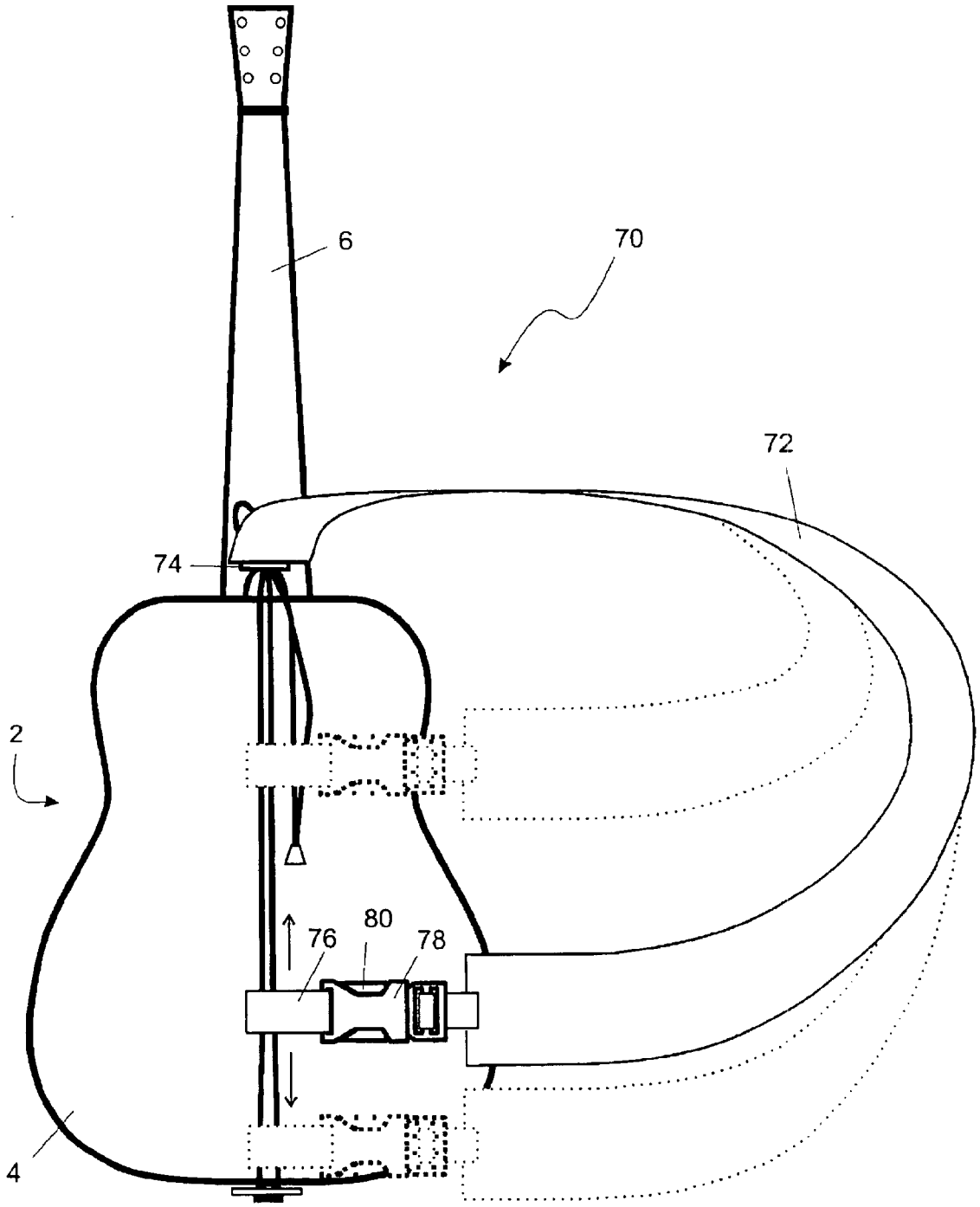
FIG. 21 is a back plan view of a guitar and the sling of FIG. 16 showing the movement of the traveler along the length of the cord.

As shown in FIGS. 15 and 16, slack in cord 42 is drawn up so that cord lock 44 abuts against cord/strap coupler 46, which draws cord 42 tight across the back of guitar body 4. While cord/strap coupler 46 is secured at the base of neck 6, traveler 48 is free to slide up and down along cord 42 across the back of guitar body 4. As shown in FIG. 17, guitar strap 60 connected directly to cord/strap coupler 46 and traveler 48. Again, coupler 46 and traveler 48 include a button 62 and each end of guitar strap 60 has a slotted buttonhole 61 for connectively receiving the button of the couplers.

Fourth Embodiment: Indirect Cord Attachment/Quick Release Connection

FIGS. 18–21 illustrate a fourth embodiment of the guitar sling of this invention designated as reference numeral 70. This embodiment of the guitar sling is identical to the third embodiment of FIGS. 12–17 in construction and function, except that the guitar strap 72 is connected to the cord/strap coupler 74 and the traveler 76 by a quick release buckle. The quick release buckles of sling 10 include a male receiver 78 and an interconnecting female latch 80. As shown, the male receiver 78 is connected to the free end of cord/strap coupler 74 and traveler 76. Two female latches 80 are connected to opposite ends of guitar strap 72.

Use

All four embodiments of the sling of this invention operate and function identically. The sling of this invention allows the musician to move and hold the guitar in any desirable instrument position, that is any position and orientation of the guitar with respect to the musician's body. More importantly, the sling will "self-balance" the guitar in any instrument position and maintain that position while the guitar is played. The sling "self balances" the guitar by allowing the guitar to right itself in any instrument position so that the weight of the guitar is naturally support by the sling without the musician altering his posture to hold or support the guitar.

As shown in FIGS. 1–4, the weight of the guitar is supported by the guitar strap, which is worn over the musician's shoulder. The movement of the traveler along the length of the cord allows the musician to selectively position the guitar in any position or orientation for an optimal instrument position. The guitar can be shifted and moved horizontally left and right across the front of the musician, as well as rotated to change the angle of the guitar neck. As the musician changes the instrument position of the guitar during the performance, the traveler will shift along the length of the cord to compensate for gravitational and external force exerted on the guitar. The movement of the traveler allows the guitar to "self balance." Consequently, the musician can move the guitar from position to position without readjusting the sling or strap connections. The sling will self balance the guitar in any position relative to the musician's body and maintain that position, while allowing the guitar to be freely played.

Like conventional guitar straps, the sling can vertically adjust the position of the guitar up and down with respect to the musician. Vertical adjustments are made simply by changing the length of the guitar strap, which is facilitated by the length adjustments on the individual guitar straps employed by the sling.

Advantages

Guitar musicians and others skilled in the art will note several advantages of this invention over conventional guitar straps. The invention makes the guitar more comfortable for the musician to play and allows more of the strap to contact the musician's back and shoulders for better distribution of the weight of the guitar. The invention allow the musician to move and hold the guitar in any desirable instrument position with respect to the musician's body. The ability to freely move and support the guitar in any desired position, greatly enhances the comfort of the musician during performance. In addition, the invention enhances the musician's musical performance. Since the guitar sling will "self-balance" the guitar in any instrument position and maintain that position while the guitar is played, the musician has greater access to the neck and strings without having to support the guitar in any particular position. The musician is able to freely move and shift the guitar between optimal instrument positions during a performance.

The invention also has some practical advantages. Conventional guitar straps do not provide a secure connection to the guitar over time. The buttonholes of conventional guitars straps can become worn, so that the guitar buttons easily come unbuttoned. Connecting the guitar straps to couplers attached to a cord securely mounted between the guitar buttons, provides a stronger, more secure connection. Furthermore, the cord locks allow the sling to be quickly removed from the guitar, without compromising the secure connection with the guitar. The use of quick release buckles, as well as, button and buttonhole attachments allows for a wide range of existing conventional guitar straps to be employed with the guitar sling's cord and coupler design. The guitar sling does not detract from the aesthetic appearance of the guitar. Except for the guitar strap, the cord, cord locks and couplers are not visible when the guitar is worn by a musician. Consequently, the sling components are hidden behind the guitar and out of the way of the musician during performance.

It should be noted that the teachings of this invention are not limited in scope by the particular embodiments of the guitar slings illustrated and described herein. One skilled in the art will note that a variety of alternatives may be substituted for the various basic components of the guitar slings illustrated and described. For example, the cord locks used to secure the cord to the strap buttons could be eliminated by simply tying the cord directly between the strap buttons without deviating beyond the scope of this invention. Likewise; the form and construction of the couplers and the traveler can be varied, modified and adapted in any manner and fashion so as to facilitate a described connection between the guitar strap, the cord and the guitar body within the scope of this invention. The basic components of the guitar slings of each embodiment were selected for their adaption and use with current guitar and strap designs, styles and conventions. It is understood that the above description does not limit the invention to the details given, but may be modified within the scope of the following claims.

I claim:

1. A guitar sling for use with a guitar strap having a first end and a second end and a guitar that includes a body having a top and bottom, neck extending from the guitar body and a first strap button extending from the guitar near the top of the guitar body and a second strap button extending from the guitar at the bottom of the guitar body, the sling comprising:

a length of cord, means for connecting the cord between the first strap button and the second strap button so that the cord extends across the back of the guitar body, first attachment means for connecting the first strap end to the guitar body, and second attachment means for connecting the second strap end to the cord for shiftable movement along the length of the cord between the first strap button and the second strap button.

2. The sling of claim 1 wherein the movement of the second attachment means along the length of the cord allows the sling when connected to the guitar strap and guitar to support and self-balance the guitar in any position.

3. The sling of claim 1 wherein the cord connecting means includes means for drawing the length of cord taut between the first strap button and the second strap button.

4. The sling of claim 1 wherein the cord connecting means includes a cord lock for securing the length of cord about one of the first strap button and the second strap button.

5. The sling of claim 4 wherein the cord lock constitutes means for drawing the length of cord taut between the first strap button and the second strap button.

6. The sling of claim 1 wherein the cord connecting means includes a coupler part having a button hole for receiving one of the first strap button and the second strap button, the cord being secured to the coupler part.

7. The sling of claim 6 wherein a cord connecting means includes a second coupler part having a button hole for receiving the other of the first strap button and the second strap button, the cord being secured between the first coupler part and the second coupler part.

8. The sling of claim 1 wherein the first attachment means includes a coupler part.

9. The sling of claim 8 wherein the coupler part has a button hole for receiving the first strap button to connect the coupler to the guitar body.

10. The sling of claim 8 wherein the coupler part includes means for fastening the coupler part to the first strap end.

11. The sling of claim 10 wherein the fastening means is a quick release buckle.

12. The sling of claim 10 wherein the fastening means is a second button hole.

13. The sling of claim 1 wherein the second attachment means includes a traveler part.

14. The sling of claim 13 wherein the traveler part has a loop through which the cord extends.

15. The sling of claim 14 wherein the traveler part includes means for fastening the coupler part to the first strap end.

16. The sling of claim 15 wherein the fastening means is a quick release buckle.

17. The sling of claim 15 wherein the fastening means is a second button hole.

18. A guitar sling used with a guitar that includes a body having a top and bottom, neck extending from the guitar body and a first strap button extending from the guitar near the top of the guitar body and a second strap button extending from the guitar at the bottom of the guitar body, the sling comprising:

a length of cord, means for connecting the length of cord between the first strap button and the second strap button so that the cord extends across the back of the guitar body, an elongated guitar strap having a first strap end adapted for connection to the guitar body and a second strap end attached to the cord for shiftable movement along the length of the cord between the first strap button and the second strap button.

19. The sling of claim 18 wherein the movement of the second strap end along the length of the cord allows the sling when connected to the guitar strap and guitar to support and self-balance the guitar in any position.

20. The sling of claim 18 wherein the first strap end includes a coupler part having a button hole for receiving the first strap button.

21. The sling of claim 18 wherein the first strap end includes a coupler part connected to the cord connecting means adjacent the first strap button.

22. The sling of claim 18 wherein the second strap end includes a traveler part having an opening though which the cord extends.

23. The sling of claim 18 wherein the coupler part includes means for fastening the coupler part to the first strap end.

24. The sling of claim 18 wherein the cord connecting means includes means for drawing the length of cord taut between the first strap button and the second strap button.

25. The sling of claim 18 wherein the cord connecting means includes a cord lock for securing the length of cord about one of the first strap button and the second strap button.

26. The sling of claim 25 wherein the cord lock constitutes means for drawing the length of cord taut between the first strap button and the second strap button.

27. The sling of claim 18 wherein the cord connecting means includes a coupler part having a button hole for receiving one of the first strap button and the second strap button, the cord being secured to the coupler part.

28. The sling of claim 27 wherein a cord connecting means includes a second coupler part having a button hole for receiving the other of the first strap button and the second strap button, the cord being secured between the first coupler part and the second coupler part.

29. A guitar sling for use with a guitar that includes a body having a top and bottom, neck extending from the guitar body and a first strap button extending from the guitar near the top of the guitar body and a second strap button extending from the guitar at the bottom of the guitar body, the sling allowing the guitar to be supported and self-balanced in any position and comprising:

a guitar strap having a first strap end and a second strap end, a length of cord, a cord lock for securing the length of cord about one of the first strap button and the second strap button, the cord lock constitutes means for drawing the length of cord taut between the first strap button and the second strap button, a coupler part connectable to the guitar body, a traveler part slidably connected to the cord for movement along the length of the cord between the first strap button and the second strap button, and means for attaching the first strap end to the coupler part and the second strap end to the traveler part.

30. A guitar sling for use with a guitar strap having a first end and a second end and a guitar that includes a body having a top and bottom, neck extending from the guitar body and a first strap button extending from the guitar near the top of the guitar body and a second strap button extending from the guitar at the bottom of the guitar body, the sling allowing the guitar to be supported and self-balanced in any position and comprising:

a length of cord, a cord lock for securing the length of cord about one of the first strap button and the second strap button, the cord lock constitutes means for drawing the length of cord taut between the first strap button and the second strap button, a coupler part connectable to the guitar body, a traveler part slidably connected to the cord for movement along the length of the cord between the first strap button and the second strap button, and means for attaching the first strap end to the coupler part and the second strap end to the traveler part.

* * * * *